US006739111B2

(12) United States Patent
Banks et al.

(10) Patent No.: US 6,739,111 B2
(45) Date of Patent: May 25, 2004

(54) AUTOMATED FILLING MACHINE AND ASSOCIATED METHOD

(75) Inventors: David P. Banks, Lake Stevens, WA (US); Darrell D. Jones, Mill Creek, WA (US)

(73) Assignee: The Boeing Company, Seattle, WA (US)

( * ) Notice: Subject to any disclaimer, the term of this patent is extended or adjusted under 35 U.S.C. 154(b) by 0 days.

(21) Appl. No.: 09/949,432

(22) Filed: Sep. 6, 2001

(65) Prior Publication Data

US 2003/0041565 A1 Mar. 6, 2003

(51) Int. Cl.[7] ..... B65B 1/16; B65B 3/14

(52) U.S. Cl. ..... 53/415; 53/471; 53/467; 53/485; 53/136.1; 53/281; 53/284.5; 53/250; 141/18; 141/21; 141/237

(58) Field of Search ..... 53/415, 420, 471, 53/467, 485, 135.1, 136.1, 281, 284.5, 284.6, 202, 168, 493, 282, 283, 250; 141/21, 18, 192, 113, 196, 237

(56) References Cited

U.S. PATENT DOCUMENTS

| | | | | |
|---|---|---|---|---|
| 3,702,625 A | | 11/1972 | Schmidt | |
| 3,788,035 A | | 1/1974 | Geisel | |
| 5,092,814 A | | 3/1992 | Kasai et al. | |
| 5,209,044 A | | 5/1993 | D'Addario et al. | |
| 5,346,425 A | | 9/1994 | Kuenzel et al. | |
| 5,471,819 A | | 12/1995 | Weckerle | |
| 5,884,457 A | * | 3/1999 | Ortiz et al. | 53/468 |
| 6,082,077 A | | 7/2000 | Christ | |
| 6,185,901 B1 | * | 2/2001 | Aylward | 53/250 |
| 6,276,409 B1 | * | 8/2001 | Ellison | 141/234 |
| 6,308,499 B1 | * | 10/2001 | Takada et al. | 53/415 |
| 6,449,927 B2 | * | 9/2002 | Hebron et al. | 53/501 |
| 6,568,151 B2 | * | 5/2003 | Buckley et al. | 53/240 |

OTHER PUBLICATIONS (Website Printout) Daeyong Laminate Tube Filling Machine; Homepage http://dyauto21.koreasme.com.
(Website Printout) Daeyong Bottle Filling Machine; Homepage http://dyauto21.koreasme.com.
(Website Printout) Daeyong Aluminum Tube Filling Machine; Homepage http://dyauto21.koreasme.com.
(Website Printout) Daeyong Tube Labeler Homepage http://dyauto21.koreasme.com.
(Website Printout) Daeyong Plastics Tube Filling Machine; Homepage http://dyauto21.koreasme.com.

* cited by examiner

*Primary Examiner*—Rinaldi I. Rada
*Assistant Examiner*—Gloria R Weeks
(74) *Attorney, Agent, or Firm*—Alston & Bird LLP

(57) ABSTRACT

An apparatus for filling a plurality of tubes is disclosed. The apparatus includes a positioning device that directs a tube from a hopper to a labeler where a label is applied to the tube. The positioning device further directs the tube to one of a plurality of filling stations where a continuous flow of filling material is dispensed into the tube. The tube is then directed to a capping device where a cap is applied to an end of the tube.

47 Claims, 4 Drawing Sheets

AUTOMATED FILLING MACHINE AND ASSOCIATED METHOD

FIELD OF THE INVENTION

The present invention relates to an apparatus and process for filling tubes and, more particularly, to an automated tube filling apparatus and process wherein a continuous flow of filling material is directed into a plurality of tubes.

BACKGROUND OF THE INVENTION

It has long been known to package merchandise and supplies in tubes. Typical products packaged in tubes include caulk, sealant, silicones, greases, as well as health supplies such as toothpaste, lotion, cleansers, and the like. Thus, there is a significant industry relating to tube filling machinery and techniques.

In the manufacturing arena, such as in the fabrication of aircraft or other large machinery, large amounts of sealant are required throughout the manufacturing process. In this regard, sealant is purchased in bulk containers and thereafter packaged into smaller, more usable quantities. Typically, industry standard tubes are used to package the sealant that are used with pneumatic guns to dispense the sealant on the various components throughout the aircraft or other machinery.

The filling operation is conventionally done by hand, since mixing the filling materials and filling the tubes are often required to be in explosion-proof facilities. A typical filling operation comprises an operator applying a label to an empty tube, filling the tube from a filling nozzle, and applying a cap. It is not unusual to fill 1000+ tubes in an eight hour shift. In many cases the packaging must be done locally because the filling material has a relatively short shelf life and, in some cases, the filled tubes must be stored frozen, which further limits their transportability. Filling over 1000 tubes manually creates a significant risk to the operator in terms of repetitive motion, which may result in carpal tunnel syndrome or other repetitive stress conditions. Manual operation also creates potential for other personal injuries from contact with the filling material or heavy machinery.

Automatic tube filling machines are known in the art, such as machines described in U.S. Pat. Nos. 3,788,035; 5,209,044; and 6,082,077. Other automatic filling machines are sold by Daeyong Filling Machinery of Korea. These conventional machines and others like them, however, suffer from several disadvantages. Specifically, some of these conventional automatic machines are electrically operated and therefore susceptible to igniting fumes during the filling operation by electrical sparks or shorts.

An even greater disadvantage with conventional filling machines is the repeated on/off cycling of the filling material pump, which can cause multi-component filling materials to be inconsistently mixed during the tube filling process. The inconsistently mixed filling material cures irregularly or not at all, which results in insufficient seals or other quality problems. In some cases where the filling material is a sealant used to seal joints in aircraft manufacturing, it has been observed that a substantial amount of the filling material is wasted due to rejections for insufficient seals from inconsistently mixed filling material. Thus, there is a need for an automatic filling machine and process that substantially eliminates inconsistently mixed filling materials during the tube filling process. Preferably, such a machine would also be explosion-proof and simple in construction.

SUMMARY OF THE INVENTION

These and other needs are provided by the apparatus for filling tubes according to the present invention. Advantageously, the apparatus of the present invention is able to direct a continuous flow of filling material into a plurality of tubes instead of directing intermittent flows into the tubes. As a result, the filling material is consistently mixed and thus provides an improved seal when the filling material is dispensed from the tube during normal use. As such, quality rejections are reduced and the overall manufacturing process is more efficient.

In particular, an apparatus for filling a plurality of tubes according to one embodiment of the present invention comprises a first filling station and a second a filling station operatively connected to at least one gas supply, such as a conventional shop air supply, wherein each filling station is operable to dispense a filling material into a respective tube. Advantageously, the gas supply is the sole source of power a majority if not all of the moving components of the apparatus, which allows the apparatus of the present invention to be used in an explosion-proof environment. In addition, the filling material dispensed by the filling stations is preferably a multi-component filling material, such as an epoxy-resin or the like.

The apparatus also includes a positioning device capable of moving between a plurality of positions, such as between a first position for receiving one of the plurality of tubes from a tube hopper or the like, and a second position for directing the tube towards the filling stations. In particular, the positioning device moves the tube along a path of travel to a selector, which is operable to selectively direct the tube to either the first filling station or the second filling station depending on which filling station is ready to receive an empty tube.

The filling stations direct a continuous flow of filling material into the tubes. In particular, a predetermined amount of filling material is dispensed into the tube until a sensor is actuated, which causes the continuous flow of filling material to be redirected into another tube. Advantageously, the flow of filling material is continuous so that the filling material is consistently mixed during the process. More specifically, the filling material pump does not intermittently start and stop during the filling process, which can cause inconsistent mixing of the filling material components. By contrast, the filling material pump runs continuously according to the present invention, and the filling material components flow through a static mixer or the like and mix consistently before being dispensed into the empty tubes.

According to one embodiment, the apparatus also includes a label applicator that is positioned proximate a third position of the positioning device. In this regard, the positioning device moves the tubes to the label applicator, where an adhesive-backed label is applied to the outer surface of the tube. In one embodiment, the positioning device includes an actuator that can rotate the tube while the positioning device is in the third position so that the label can be easily applied to the rotating tube. The label applicator can be positioned in several locations along the tubes' path of travel, and in one embodiment is positioned between the first position and third position of the positioning device.

The apparatus also includes a capping device downstream from the filling stations. The capping device includes a cap supply source, such as a cap hopper, a capping station, and a cap feed system capable of directing and aligning a plurality of caps along a path of travel from the cap supply source to the capping station. In operation, the cap feed system moves the caps along an elevator, such as a moving endless belt. At least one orienting device is located along the elevator or elsewhere along the path of travel. The caps are directed to the capping station where they are applied to the end of the tubes. Advantageously, the capping device is powered solely by at least one fluid supply, such as by a standard shop air line. In particular, an elevator drive is operatively connected to the fluid supply, and in one embodiment the drive includes a clutch that limits torque output of the drive if a cap becomes jammed in the capping device.

The apparatus also comprises several safety devices or safety interlocks that protect the operator and prevent damage to the apparatus. One such safety device is a safety door that must be positioned over the tube hopper such that a pair of interlock members suitably engage either mechanically or proximally. If the safety door is not in place over the hopper, new tubes that are not already in process will not be fed through the apparatus. Another interlock is located at a main door so that the apparatus will not operate when the door is opened, such as by opening a latch and pivoting the door about hinges.

Accordingly, the apparatus of the present invention provides a safe and efficient method of filling tubes that avoids the problems of conventional tube filling devices. The apparatus of the present invention is particularly advantageous when the filling material comprises a plurality of components. In particular, because the apparatus of the present invention directs a continuous flow of filling material into the tubes, the filling material pump does not start and stop during the filling operation. As a result, the filling material is consistently mixed and provides better quality seals and less wasted material.

BRIEF DESCRIPTION OF THE DRAWINGS

Figure 1A:
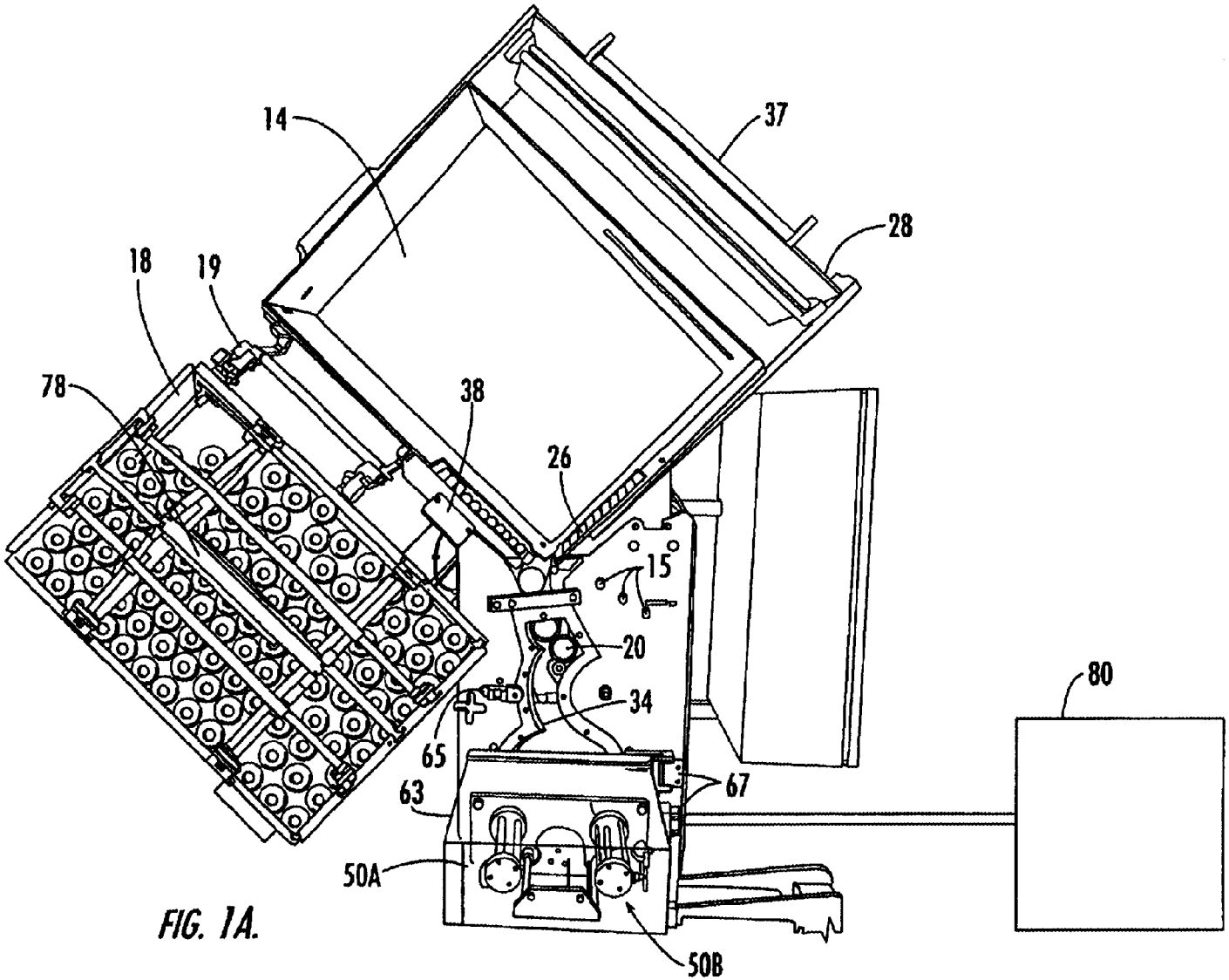
Figures 1B, 2, 3:
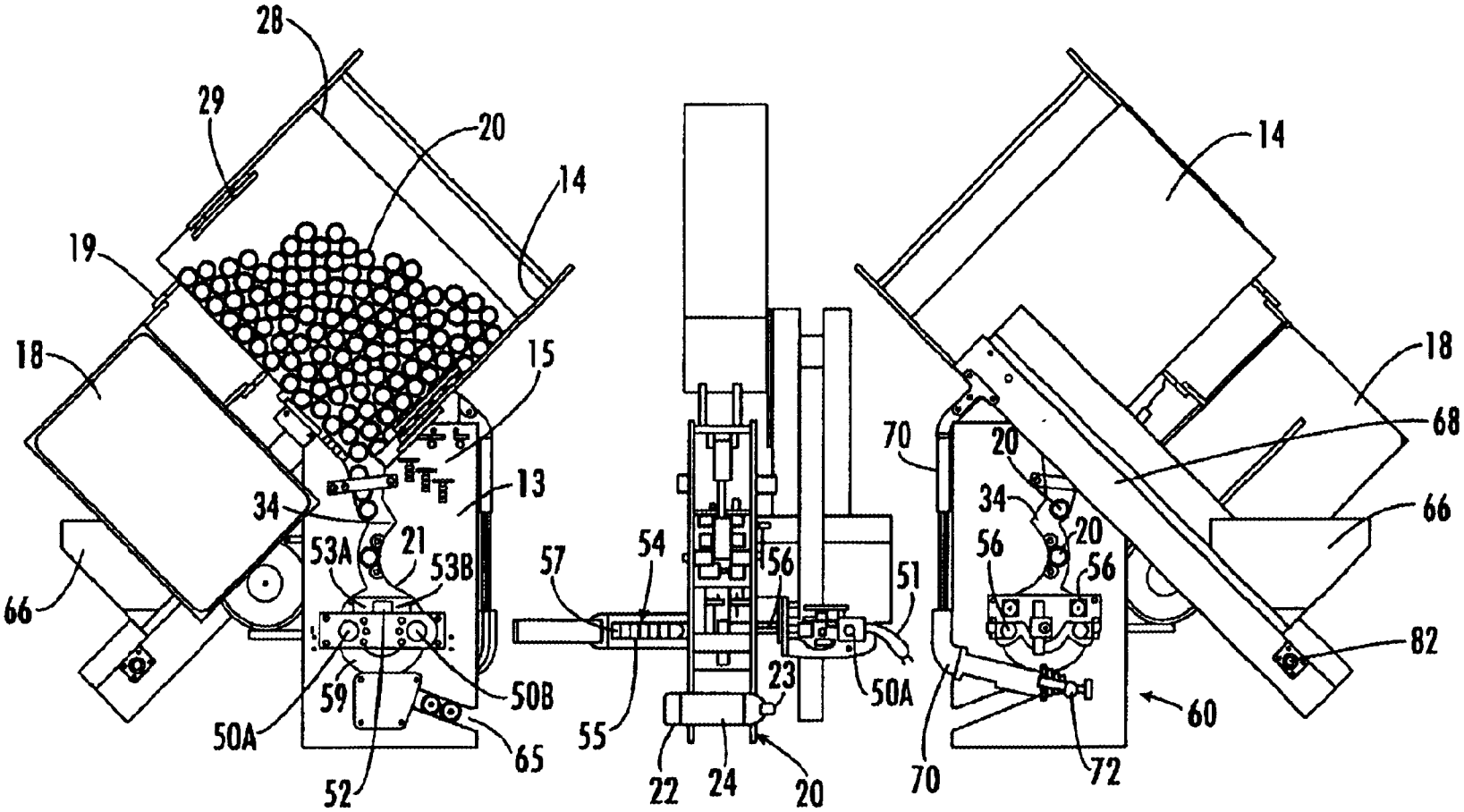
Figure 1C:
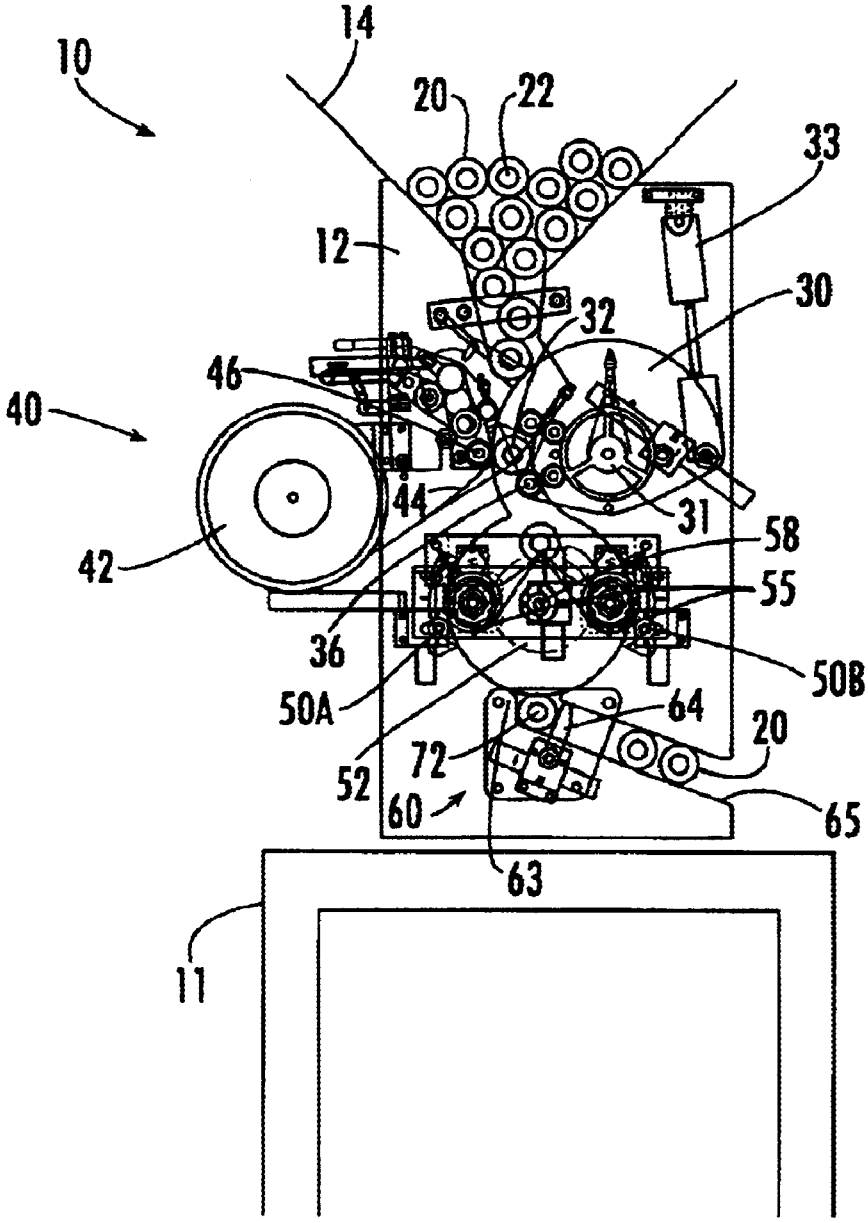
Figure 4:
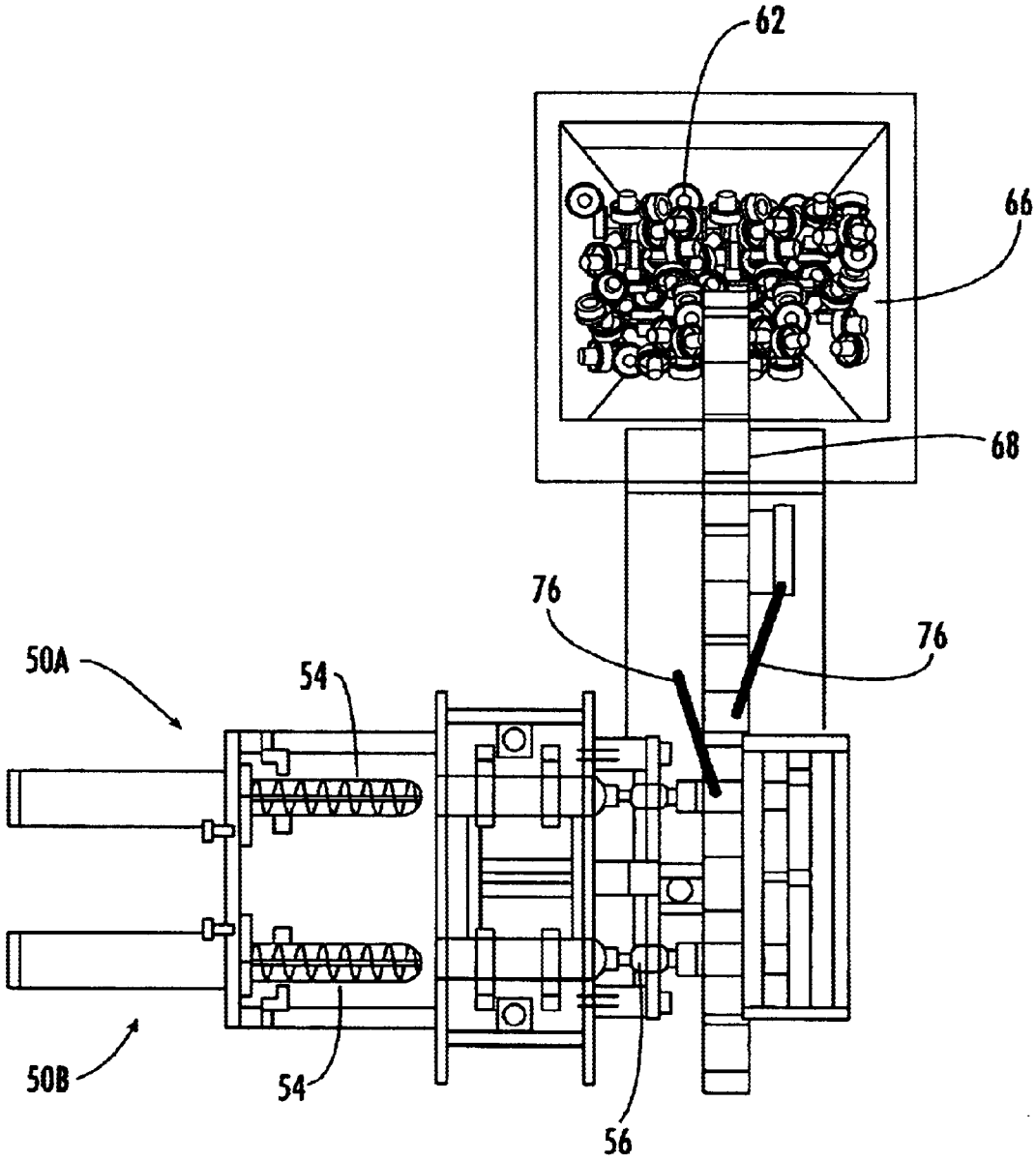

Having thus described the invention in general terms, reference will now be made to the accompanying drawings, which are not necessarily drawn to scale, and wherein:

FIG. 1A shows a front view of an apparatus for filling tubes according to one embodiment of the present invention as a plurality of tubes are being loaded into the apparatus;

FIGS. 1B and 1C show front views of an apparatus for filling tubes according to one embodiment of the present invention after a plurality of tubes have been loaded into the apparatus;

FIG. 2 is a side view of the apparatus shown in FIG. 1B;

FIG. 3 is a rear view of a portion of the apparatus shown in FIG. 1B; and FIG. 4 is a top view of a portion of an apparatus for filling tubes according to one embodiment of the present invention.

DETAILED DESCRIPTION OF THE INVENTION

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

FIGS. 1A–1C show various front elevation views of an apparatus 10 for filling tubes according to one embodiment of the present invention. The apparatus 10 is shown in FIG. 1C on a stand 11, which may be stationary or on a movable platform, such as wheels. Although not shown, versions of FIGS. 1A and 1B may also be on a stand, if desired. In one embodiment, the apparatus 10 is easily transportable and sized such that the apparatus can fit through standard door dimensions. The apparatus 10 comprises a frame 12 having several components mounted or attached thereto for directing a plurality of empty tubes from a tube hopper to one of a plurality of filling stations and filling the tubes with a filling material, such as a multi-component commercial sealant used in the fabrication of aircraft or other types of machinery. Single component filling materials can also be used in accordance with the present invention. The apparatus 10 also includes a front panel 13 upon which a number of apparatus control switches 15 are located, such as a power switch, feed switch, and a jogger switch. The power switch controls the overall operation of the apparatus 10, and in one embodiment the apparatus initially performs an initial reset of all functions when the power switch is switched to the "on" position.

In particular, the apparatus 10 according to one embodiment of the present invention includes a tube hopper 14 that is capable of storing a plurality of tubes 20. The tubes 20 are typically loaded into the hopper 14 in a batch process, although the tubes could also be loaded into the hopper by hand, by conveyor, or other automatic or manual methods. In a presently preferred embodiment, the tubes 20 come pre-aligned in a box (not shown) so that they can be easily removed en masse by a gripping device 78 and placed into a tube transfer box 18 (FIG. 1A). In one embodiment, up to about 125 tubes 20 can be gripped by the gripping device 78 and placed into the transfer box 18. The tube transfer box 18 is pivotable about hinges 19 so that the tubes 20 can be loaded into the hopper 14 in a uniform arrangement (FIG. 1B). The hopper 14 preferably tapers to a throat 16 so that only one tube can pass through the throat at a time. In addition, a jogger 26 is provided in the hopper 14 to jostle or move the tubes 20 so that the tubes do not bridge or block the throat 16. In one embodiment, the jogger 26 is independently controlled by the jogger switch mentioned above.

The tubes 20 travel along a predetermined path of travel or channel 21 from the hopper 14 to a plurality of filling stations 50A, 50B. The tubes 20 are directed to the filling stations 50A, 50B by a positioning device 30 that is rotatable about an axis 31 and defines at least one cavity 32 that is sized to accommodate one of the tubes 20. The positioning device 30 can rotate to several positions, whereby in one position a cavity 32 of the positioning device is aligned with the hopper throat 16 so that a tube 20 drops into the cavity. When the positioning device 30 rotates about its axis 31, the tube 20 positioned in the cavity 32 is directed along a guide channel 34 toward the filling stations 50A, 50B. As discussed more fully below, the filling stations 50A, 50B direct a continuous flow of a filling material 24, such as a sealant, silicone, grease, or other flowable material into the tubes such that air or other gas does not become entrapped in the filling material 24 during the filling process.

The apparatus also includes a labeler 40 that is proximate the guide channel 34 for applying pressure-sensitive stickers or labels 44 to the outer surface of the tubes 20 as the tubes are directed along the guide channel. To assist in the label transfer from the labeler 40 to the tubes 20, the positioning device 30 includes at least one actuator 36, such as a powered roller or a plurality of ball bearings, that is positioned at least partially in the cavity 32 and in contact with the tube so as to cause the tube to likewise rotate in the cavity. A whisker valve or the like triggers the actuator 36 when a label is ready to be applied to a tube such that the tube rotates as the label is applied. In one embodiment, the labeler 40 is positioned along the guide channel 34 between the hopper 14 and the filling stations 50A, 50B, although the labeler could be located elsewhere in the process. The labels 44 are directed on a backing material from a label dispenser 42 to a series of rolls 46 and over a knife edge (not shown) so that each label is peeled from the backing material and the adhesive side of the label contacts the rotating tube 20.

After the label 44 is applied to the tube 20, the positioning device 30 rotates further so as to move the tube to a selector 52 that is positioned proximate the filling stations 50A, 50B. In one embodiment, the selector 52 has opposing sides 53A, 53B and is capable of moving, such as by rotating, so that one of the sides of the selector contacts the tube 20 to direct the tube into an empty filling station. In one embodiment, the selector 52 is an elongate member that pivots about an axis like a metronome directing consecutive tubes to respective filling stations. The selector 52 can have various alternative shapes as well, such as having a relatively round shape defining at least one cavity about an outer edge thereof, whereby each cavity is sized to receive a tube from the channel 34 as the selector pivots or moves in a repeating pattern. In addition, where three or more different filling stations are present, the selector can be designed to direct tubes into their respective filling stations in other manners, such as by providing a multi-position selector that can selectively communicate with each filling station.

In particular, the selector 52 directs tubes into respective empty filling stations by determining which filling station is empty and directing the respective empty tube into the filling station. This can be performed by a variety of conventional devices, such as photoelectric eyes and the like, but is preferably performed using a pneumatically controlled proximity switch that operates like an electric proximity switch in that the switch does not need to contact an object for the object to be detected. The pneumatic proximity switch is supplied with about a 3–5 psi air supply, and when an object gets close to the face of the proximity switch, a slight back pressure is created that is used to activate an amplifying valve indicating the presence of a tube. Conversely, the amplifying valve will not be actuated if a tube is not present at the filling station. In this regard, the selector 52 helps determine which filling stations are available to receive empty tubes.

FIG. 2 shows a side view of the apparatus 10. In one embodiment, an empty tube 20 is directed by the selector 52 into one of the empty filling stations, for example filling station 50A. The tube 20, which preferably includes a plunger 22 therein that initially is positioned proximate a forward end 23 of the tube, is releasably secured in the filling station by a mandrel 54 that is inserted into the tube. A dispensing nozzle 56 is positioned adjacent the forward end 23 of the tube 20 and can be positioned so that the tube engages the dispensing nozzle and is in fluid engagement therewith. The dispensing nozzle 56 is also in fluid communication with a supply of filling material 24, which can be in the form of at least one portable container, such as a barrel or tote, or in the form of at least one hard piped source that is operatively connected to the dispensing nozzle via a tube or the like. In one embodiment, the apparatus 10 includes a multi-valve manifold that is connected via a flexible rubber hydraulic hose 51 to a sealant dispensing device, such as a sealant dispensing machine manufactured by Graco and sold by Ken R. Humke of Tukwilla, Wash.

The apparatus 10 is particularly advantageous when the filling material 24 comprises a plurality of components. Multi-component filling materials are often used as sealants and the like where the filling material components mix or react together to form a desired effect. Many times the filling material has a relatively short cure time, such as about 2 hours or less, when the components are mixed consistently. If the components are not mixed consistently, the filling material may not cure and thus result in insufficient seals or other quality problems described above. The filling material 24 according to the present invention is preferably supplied by multiple sources, such as those described above, each containing a component of the filling material. The components are drawn through a conventional static mixer (not shown) to the manifold and the dispensing nozzles 56. Because the apparatus 10 provides a continuous flow of filling material 24 to the tubes 20, the filling material components flow through the static mixer without intermittent starts and stops, which would disrupt the flow of filling material components and cause the filling material to be inconsistently mixed.

As described above, the dispensing nozzle 56 is operable to dispense a flow of consistently mixed filling material 24 into an empty tube 20 so as to push the plunger 22 back to a predetermined position. Specifically, if the plunger 22 is pushed back to the predetermined position, such as when the tube is substantially full, the plunger actuates a sensor 57 that stops the dispensing nozzle 56 from dispensing or directing the filling material 24 into the tube. As shown in FIG. 2, the predetermined position of each filling station 50A, 50B can be set by guides 55 or the like that indicate the position of the sensor 57. The mandrel 54 then retracts, and the tube 20 disconnects from the dispensing nozzle and exits the filling station. The tube 20 is then directed to a capping device 60, as discussed below. In one embodiment, the selector 52 is removable so that other parts of the apparatus 10, such as parts of the filling stations 50A, 50B, can be easily accessed, such as for cleaning purposes or the like. In addition, if both of the filling stations 50A, 50B have tubes 20 loaded therein, the apparatus 10 will hold the next available empty tube by halting movement of the selector 52 until one of the filling stations becomes available.

Advantageously, the selector 52 continuously directs tubes from the guide channel 34 to empty filling stations so that the flow of filling material 24 can be continuously directed into the tubes by respective dispensing nozzles 56. In this regard, the apparatus 10 includes a dispensing valve 58 that directs the flow of filling material 24 from one dispensing nozzle 56 to another automatically so that the flow of filling material is continuous. As discussed above, this is advantageous because the pump (not shown) controlling the flow of filling material 24 operates at a steady state instead of frequently starting and stopping as in conventional operations. As a result, the mixture of materials forming the filling material 24 (if formed of more than one material) is consistent. If more than three filling stations are present, the dispensing valve 58 may permit the flow of filling material to be continuously directed into more than one tube simultaneously.

FIGS. 3 and 4 show rear and top views of the apparatus 10. According to one embodiment, the apparatus 10 also includes a capping device generally referenced as 60. The capping device 60 operates relatively independently of the rest of the apparatus 10 and provides caps 62 in a "supply on demand" basis. The capping device 60 includes a capping station 72 that is positioned downstream of the plurality of filling stations 50A, 50B so that caps 62 can be removably attached or applied to the forward end 23 of respective tubes 20. More specifically, after each of the tubes 20 is filled with a predetermined amount of filling material 24, an actuator 55, such as a release lever or the like, positioned adjacent each filling station 50A, 50B releases the respective tube so that the tube drops or is directed down a track 59 to the capping device 60. The capping device 60 defines a cavity 63 sized to receive a tube 20 from the track 59 and retains the tube in the cavity with a release member 64, such as a pivotal lever, which releases the tube down a chute 65 or the like after the capping operation.

The capping device 60 includes a cap hopper 66 that is able to store a plurality of loose, randomly-oriented caps 62, and an elevator 68 for directing the caps from the hopper to the capping station 72. The capping device 60 also includes a drive 82 that operates the elevator 68 and other elements of the capping device. In one embodiment, the drive 82 is a pneumatically-driven motor that is protected by a clutch or other torque-limiting device to prevent damage to the motor if a jam occurs. An example of such a motor is manufactured under model #MMR0001 by Micro Motors Inc. and sold by Airtronics of Bellevue, Wash. The elevator 68 includes an endless belt having plurality of raised members 74 or plates that help retain the caps 62 on the belt as the belt transports the caps towards the capping station 72. The capping device 60 also includes at least one, and preferably at least two, straightening/reject members 76 extending partially across the elevator belt such that only one cap 62 is positioned on a raised member 74 while insuring that the cap is properly oriented on the belt. The elevator 68 is operatively connected to an orienting track 70 so that caps 62 travelling along the elevator belt are deposited at one end of the belt into the orienting track. The orienting track 70 further aligns the caps 62 and directs the caps to the capping station 72, where an actuator known in the art presses the caps onto the forward ends 23 of the tubes 20.

Advantageously, the apparatus 10 is fluid powered, i.e., pneumatically or liquid powered, such that the apparatus is essentially explosion-proof. In a preferred embodiment, the apparatus 10 is air powered wherein all actuators, the positioning device 30, the labeler 40, the filling stations 50A, 50B, the capping device 60, and other moving components are all controlled by compressed gas, such as air. The apparatus 10 includes a manifold that is connected to a conventional multi-line air connector, such as a multi-line air connector manufactured by Twintec, model #TWN1BH-4, and sold by Airtronics in Bellevue, Wash. The multi-line air connector is connected to a main air supply 80, such as standard regulated shop air at a pressure of about 90 psi. In one embodiment, the apparatus 10 also includes a La-Mann air filter/dryer (not shown) also sold by Airtronics in Bellevue, Wash. The air filter/dryer allows a small leakage of air to occur to drain any unwanted moisture.

The apparatus 10 also includes at least one interlock or safety device that prevents portions of the apparatus from operating for safety and convenience. For example, the tube hopper 14 includes a safety door 28 that must be positioned over the hopper such that a pair of interlock members 37, 38 suitably engage either mechanically or proximally. The safety door 28 can be pulled down over the hopper 14 using handles 29 after the tubes 20 have been loaded into the hopper. If the safety door 28 is not in place over the hopper 14, the tube jogger 26 will not operate, and new tubes that are not already in process will not be fed through the apparatus 10. Thus, it is possible to continue processing tubes 20 through the apparatus 10 while loading more empty tubes in the hopper 14. Another interlock is located at a main door 63 so that the apparatus 10 will not operate when the door 63 is opened by opening a latch 65 and pivoting the door 63 about hinges 67. Other interlocks can be provided, for example, near the capping station 72, cap orienting track 70, and filling stations 50A, 50B.

Thus, the apparatus 10 of the present invention is capable of filling a plurality of tubes such that the filling material is consistently mixed during the filling process. In this regard, the multi-position selector valve 58 directs a continuous flow of filling material into the tubes so that the filling material pump does not intermittently start and stop during the filling process. In addition, the apparatus 10 of the present invention is preferably pneumatically driven and thus can be used in hazardous environments, such as when filling tubes with volatile or flammable filling materials. The apparatus 10 is also readily portable, and substantially eliminates operator repetitive stress disorders caused by manually filling tubes. Further, the apparatus 10 directs the filling material 24 into the tubes 20 such that substantially no air is entrapped in the filling material during the filling operation that can cause further inconsistencies in the filling material and more wasted material.

Many modifications and other embodiments of the invention will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. An apparatus for filling a plurality of tubes, comprising:

a first filling station and a second filling station operatively connected to a gas supply, each filling station operable to dispense a flowable filling material into a respective tube;

a positioning device capable of moving between a plurality of positions, the plurality of positions including a first position for receiving one of the plurality of tubes and a second position for directing the tube towards the first and second filling stations;

a selector operable to selectively direct the tube to either the first filling station or the second filling station; and a dispensing valve adapted for dispensing a continuous flow of the flowable filling material into the first film station and then into the second film station.

2. An apparatus according to claim 1, further comprising a label applicator, wherein the plurality of positions of the positioning device includes a third position proximate the label applicator such that a label can be applied to the tube.

3. An apparatus according to claim 2, wherein the positioning device includes an actuator capable of rotating die tube while the positioning device is in the third position so as to effect application of the label to the tube.

4. An apparatus according to claim 1, further comprising a capping device operable to removably attach a cap to an end of the tube.

5. An apparatus according to claim 4, wherein the capping device comprises a cap supply source, a capping station, and a cap feed system capable of directing and aligning a plurality of caps along a path of travel from the cap supply source to the capping station.

6. An apparatus according to claim 5, wherein the cap supply source is a cap hopper capable of storing a plurality of loose caps.

7. An apparatus according to claim 1, wherein the gas supply is the sole power source for the apparatus.

8. An apparatus according to claim 1, further comprising a tube hopper for storing empty tubes, the rube hopper capable of supplying tubes to the positioning device.

9. An apparatus according to claim 1, wherein the first and second filling stations are adapted to dispense a filling material selected from the group consisting of sealants, silicones, and greases.

10. An apparatus according to claim 1, wherein the filling material includes a plurality of components that are consistently mixed.

11. An apparatus according to claim 1, further comprising at least one interlock device that prevents at least one portion of the apparatus from operating when the interlock device is engaged.

12. A fluid-powered apparatus for filling a plurality of tubes, comprising:

a first filling station and a second filling station operatively connected to at least one fluid supply such that the apparatus is operated using fluid solely from the at least one fluid supply, each filling station operable to dispense a filling material into a respective tube;

a label applicator capable of applying a label to a respective tube;

a positioning device capable of moving between a plurality of positions, the plurality of positions including a first position for receiving one of the plurality of tubes, a second position for directing the tube towards the first and second filling stations, and a third position proximate the label applicator such that a label can be applied to the tube;

a selector operable to direct the tube from the second position of the positioning device to either the first filling station or the second filling station; and a capping device operable to removably attach a cap to an end of the tube.

13. A fluid-powered apparatus according to claim 12, wherein the positioning device includes an actuator capable of rotating the tube while the positioning device is in the third position so as to effect application of the label to the rube.

14. A fluid-powered apparatus according to claim 12, wherein the capping device comprises a cap supply source, a capping station, and a cap feed system capable of directing and aligning a plurality of caps along a path of travel from the cap supply source to the capping station.

15. A fluid-powered apparatus according to claim 14, wherein the cap supply source is a cap hopper capable of storing a plurality of loose caps.

16. A fluid-powered apparatus according to claim 12, further comprising a tube hopper for storing empty tubes, the rube hopper capable of supplying tubes to the positioning device.

17. A fluid-powered apparatus according to claim 12, wherein the first and second filling stations are adapted to dispense a filling material selected from the group consisting of sealants, silicones, and greases.

18. A fluid-powered apparatus according to claim 12, wherein at least a portion of the at least one fluid supply is selected from the group consisting of a pneumatic supply and a hydraulic supply.

19. A method of filling tubes, comprising the steps of:

moving a first tube along a path of travel from a first position to a second position, the second position being proximate at least two filling stations;

directing the first tube to one of the at least two filling stations;

filling a predetermined portion of the first tube with a flowable filling material while at a filling station;

moving a second tube along a path of travel from a first position to a second position;

directing the second tube to another of the at least two filling stations; and filling a predetermined portion of the second tube with the flowable filling material while the second tube is at a filling station such that a continuous flow of filling material is directed from the first tube into the second tube, the continuous flow of filling material being consistently mixed.

20. A method according to claim 19, wherein the first tube filling step and the second tube filling step include filling the respective tube with a consistently-mixed, multi-component filling material.

21. A method according to claim 19, wherein the first tube moving step and the second tube moving step include moving the first and second tubes consecutively along a respective path of travel from a tube feed throat to a selector device.

22. A method according to claim 19, wherein the first tube directing step and the second tube directing step include urging a selector device against the first and second tubes consecutively such that the first and second tubes are directed into different filling stations.

23. A method according to claim 19, wherein at least the first tube filling step includes urging the first tube onto a dispensing nozzle and filling the first tube with a predetermined amount of filling material.

24. A method according to claim 19, wherein the second tube filling step includes actuating a dispense valve to direct the continuous flaw of filling material from one of the at least two filling stations corresponding to the first tube to another of the at least two filling stations corresponding to the second tube.

25. A method according to claim 24, further comprising actuating the dispense valve to direct the continuous flow of filling material from the filling station corresponding to the second tube to a filling station corresponding to a third tube.

26. A method according to claim 25, wherein the dispense valve actuating step includes directing the flow of filling material from the filling station corresponding to the second tube to a filling station that consecutively receives the first tube and the third tube.

27. A method according to claim 25, wherein all of the steps are carried out using compressed gas as a power source.

28. A method according to claim 24, further comprising applying a cap to an end of each of the first and second tubes after filling a predetermined portion of each tube with the filling material.

29. A method according to claim 28, further comprising directing one of the first and second tubes from a respective filling station to a capping station whereby the cap is applied to the tube.

30. A method according to claim 19, wherein the first tube moving step and the second tube moving step include moving the first tube and the second tube along a common path of travel.

31. A method of filling tubes, comprising the steps of:

moving a first tube along a path off travel from a first position to a second position, the second position being proximate at least two filling stations;

applying a label to the first rube during its movement along the path of travel;

directing the first tube to one of the at least two filling stations following application of the label;

filling a predetermined portion of the first tube with a flowable filling material at a filling station;

moving a second tube along a path of travel from a first position to a second position;

applying a label to the second tube during its movement along the path of travel;

directing the second tube to another of the at least two filling stations following application of the label;

filling a predetermined portion of the second tube with the flowable filling material at a filling station such that a continuous flow of filling material is directed from the first tube into the second tube, the continuous flow of filling material being consistently mixed; and applying a cap to an end of each of the first and second tubes following filling of the tubes.

32. A method according to claim 31, wherein the first tube filling step and the second tube filling step include filling the respective tube with a consistently-mixed, multi-component flowable filling material.

33. A method according to claim 31, wherein the first rube moving step and the second tube moving step include moving the first tube and the second tube along a common path of travel leading to the at least two filling stations.

34. A method according to claim 32, wherein the first tube label applying step includes applying a label at a predetermined position between the first position and the second position of the first tube.

35. A method according to claim 31, wherein the first tube moving step and the second tube moving step include moving the first and second tubes consecutively along a respective path of travel from a tube feed throat to a selector device.

36. A method according to claim 31, wherein the first tube directing step and the second tube directing step include urging a selector against the first and second tubes consecutively such that the first and second tubes are directed into different filling stations.

37. A method according to claim 31, wherein at least the first tube filling step includes urging the first tube onto a dispensing nozzle and filling the first tube with a predetermined amount of filling material.

38. A method according to claim 31, wherein the second tube filling step includes actuating a dispense valve to direct the continuous flow of filling material from one of the at least two filling stations corresponding to the first tube to another of the at least two filling stations corresponding to the second tube such that the continuous flow of filling material is consistently mixed.

39. A method according to claim 38, further comprising actuating the dispense valve to direct the continuous flow of filling material from the filling station corresponding to the second tube to a filling station corresponding to a third tube.

40. A method according to claim 39, wherein the dispense valve actuating step includes directing the flow of filling material from the filling station corresponding to the second tube to a filling station that consecutively receives the first tube and the third tube.

41. A method according to claim 38, further comprising applying a cap to an end of each of the first and second tubes after filling at least a portion of each tube with the filling material.

42. A method according to claim 41, further comprising directing one of the first and second tubes from a respective filling station to a capping station whereby the cap is applied to the tube.

43. A method according to claim 31, wherein all of the steps are carried out using compressed gas as a power source.

44. A method of filling tubes, comprising the steps of:

gripping a plurality of aligned, empty tubes;

loading the aligned, empty tubes in a tube hopper while the aligned, empty tubes are gripped;

directing one of the aligned, empty tubes from a feed throat of the tube hopper to a label applicator;

applying a label to the tube at the label applicator;

directing the tube to a selector device operable to direct the tube to one of a plurality of filling stations following application of the label;

directing a predetermined portion of a continuous stream of multi-component flowable filling material into a tube while the tube is at a filling station such that a sensor is actuated;

redirecting the continuous stream of flowable filling material to another filling station after the sensor is actuated such that the flowable filling material is consistently mixed; and applying a cap to an end of the tube.

45. A method according to claim 44, wherein the filling material directing step includes directing the continuous stream of filling material into the tube until a plunger inside the tube actuates die sensor.

46. A method according to claim 44, wherein the label applying step includes rotating the tube in a positioning device so that the label is applied to an outer surface of die tube.

47. A method according to claim 44, wherein the cap applying step includes directing the tube from the filling station to a capping station.

* * * * *